US007758409B2

(12) United States Patent
Yamashita et al.

(10) Patent No.: US 7,758,409 B2
(45) Date of Patent: Jul. 20, 2010

(54) INDOOR UNIT OF AIR CONDITIONER

(75) Inventors: Tetsuya Yamashita, Kusatsu (JP); Tatsuhiko Akai, Kusatsu (JP); Takashi Doi, Kusatsu (JP); Toshiyuki Natsume, Kusatsu (JP); Atsushi Kataoka, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 332 days.

(21) Appl. No.: 10/573,042

(22) PCT Filed: Sep. 9, 2004

(86) PCT No.: PCT/JP2004/013152

§ 371 (c)(1),
(2), (4) Date: Mar. 22, 2006

(87) PCT Pub. No.: WO2005/033587

PCT Pub. Date: Apr. 14, 2005

(65) Prior Publication Data

US 2007/0012062 A1 Jan. 18, 2007

(30) Foreign Application Priority Data

Sep. 30, 2003 (JP) ..... 2003-340513
Sep. 30, 2003 (JP) ..... 2003-340514

(51) Int. Cl.
*F24F 7/00* (2006.01)
*F24F 1/00* (2006.01)

(52) U.S. Cl. ..... 454/313; 454/233

(58) Field of Classification Search ..... 454/313, 454/233

See application file for complete search history.

(56) References Cited

U.S. PATENT DOCUMENTS 5,782,688 A 7/1998 Baek et al.
5,810,658 A * 9/1998 Seo ..... 454/233
6,000,246 A * 12/1999 Hsieh et al. ..... 66/151
6,062,612 A * 5/2000 Lin ..... 292/144
6,725,684 B2 4/2004 Lee et al.
2002/0189274 A1 12/2002 Lee et al.

FOREIGN PATENT DOCUMENTS

| | | | |
|---|---|---|---|
| CN | 1403748 | A | 3/2003 |
| EP | 0 984 227 | A2 | 3/2000 |
| EP | 1271065 | A | 1/2003 |
| JP | 3-6232 | U | 1/1991 |
| JP | 3-97113 | U | 10/1991 |
| JP | 4-20923 | U | 2/1992 |
| JP | H05-187706 | A | 7/1993 |
| JP | 7-12821 | U | 1/1995 |
| JP | 9-210402 | A | 8/1997 |
| JP | 10-109872 | A | 4/1998 |
| JP | 10-217876 | A | 8/1998 |
| JP | 11-345650 | A | 12/1999 |
| JP | 2000-039171 | A | 2/2000 |
| JP | 2003-014249 | A | 1/2003 |
| KR | 0127611 | Y1 | 7/1997 |
| KR | 20-0312142 | | 5/2003 |
| WO | WO-02-103248 | | 12/2002 |

* cited by examiner

*Primary Examiner*—Steve McAllister
*Assistant Examiner*—Helena Kosanovic
(74) *Attorney, Agent, or Firm*—Global IP Counselors

(57) ABSTRACT

The present invention provides an indoor unit of an air conditioner, which is capable of improving the mounting accuracy between a front grill and a movable panel. An indoor unit of the air conditioner includes a main body casing, a front grill, a second panel, a driving machine, and an opening and closing mechanism. The front grill is provided forward of the main body casing and includes a first intake port. The second panel is capable of moving so as to open and close the first intake port. The driving machine is provided in the main body casing, and generates a driving force to move the second panel. The opening and closing mechanism is provided at the front grill, and moves the second panel by the driving force of the driving machine to open and close the first intake port.

18 Claims, 9 Drawing Sheets

INDOOR UNIT OF AIR CONDITIONER

CROSS-REFERENCE TO RELATED APPLICATIONS

This U.S. National stage application claims priority under 35 U.S.C. §119(a) to Japanese Patent Application Nos. 2003-340513, filed in Japan on Sep. 30, 2003, and 2003-340514, filed in Japan on Sep. 30, 2003, the entire contents of which are hereby incorporated herein by reference.

TECHNICAL FIELD

The present invention relates to an indoor unit of an air conditioner.

BACKGROUND ART

Some indoor units of air conditioners are equipped with a movable panel, a drive portion, and an opening and closing mechanism. The movable panel is, for example, a panel that moves so as to open and close an opening such as an intake port. The drive portion generates a driving force to move the movable panel. The opening and closing mechanism is a mechanism to move the movable panel by a driving force of the drive portion, and for example, it comprises a gear which transmits a driving force of a motor and the like. In addition, indoor units of air conditioners are equipped with a main body casing that houses a heat exchanger, a ventilation fan, and the like, and the drive portion is often provided in the main body casing. Consequently, with conventional indoor units of air conditioners, in many cases, the opening and closing mechanism is also provided in the main body casing (see for example, Japanese Patent Publication No. 07-12821).

On the other hand, many of the recent indoor units of air conditioners are equipped with a front grill that is mounted to the main body casing. The front grill is mounted to the front of the main body casing, and has openings such as an intake port and an outlet. With such an indoor unit of the air conditioner, the above described movable panel is movably provided so as to open and close the openings of the front grill. Then, the movable panel opens and closes the openings by the drive portion and the opening and closing mechanism provided in the main body casing. In other words, even when the front grill is mounted to the main body casing, since the drive portion is provided in the main body casing, the opening and closing mechanism is also provided in the main body casing in many cases.

SUMMARY OF THE INVENTION

However, when the opening and closing mechanism is provided in the main body casing as described above, there is the risk that the mounting accuracy between the movable panel and the front grill will be reduced. In other words, when the opening and closing mechanism is provided in the main body casing, the movable panel to be opened and closed by the opening and closing mechanism will be positioned with the main body as a reference. Consequently, there is a risk that the mounting accuracy between the movable panel that opens and closes the openings of the front grill and the front grill will be reduced.

It is therefore an object of the present invention is to provide an indoor unit of an air conditioner that is capable of improving the mounting accuracy between the front grill and the movable panel.

An indoor unit of an air conditioner according to a first aspect of the present invention includes a main body casing, a front grill, a first movable panel, a drive portion, and an opening and closing mechanism. The front grill is provided forward of the main body casing, and has a first opening. The first movable panel is capable of moving so as to open and close the first opening. The drive portion generates a driving force to move the first movable panel. The opening and closing mechanism is provided at the front grill, and moves the first movable panel by the driving force of the drive portion to open and close the first opening.

With this indoor unit of the air conditioner, the opening and closing mechanism is provided at the front grill not in the main body casing. Consequently, the first movable panel that is moved by the opening and closing mechanism is positioned with the front grill as a reference rather than the main body casing. Consequently, with this indoor unit of the air conditioner, the mounting accuracy between the front grill and the first movable panel can be improved.

An indoor unit of an air conditioner according to a second aspect of the present invention is the indoor unit of the air conditioner according to the first aspect, wherein at least when the front grill is mounted to the main body casing, the drive portion is provided in the main body casing.

With this indoor unit of the air conditioner, at least when the front grill is mounted to the main body casing, the drive portion is provided in the main body casing. With such type of conventional indoor unit of an air conditioner, in many cases, the opening and closing mechanism is also provided in the main body casing in accordance with the position of the drive portion. However, with this indoor unit of the air conditioner, the opening and closing mechanism is provided at the front grill not in the main body casing. Consequently, with this indoor unit of the air conditioner, even if it is configured such that the drive portion is provided in the main body casing, the mounting accuracy between the front grill and the first movable panel can be improved.

An indoor unit of an air conditioner according to a third aspect of the present invention is the indoor unit of the air conditioner of the first or the second aspect, wherein the opening and closing mechanism has a supporting member. The supporting member is mounted to the first movable panel and supports the first movable panel.

With this indoor unit of the air conditioner, the opening and closing mechanism has the supporting member. In other words, the supporting member that supports the first movable panel is provided at the front grill. Consequently, the first movable panel supported by the supporting member is positioned with the front grill as a reference rather than the main body casing. Consequently, with this indoor unit of the air conditioner, the mounting accuracy between the front grill and the first movable panel can be improved.

An indoor unit of an air conditioner according to a fourth aspect of the present invention is the indoor unit of the air conditioner according to any one of the first through the third aspects, wherein the opening and closing mechanism has a speed reducing mechanism. The speed reducing mechanism transmits the driving force of the drive portion to the first movable panel.

With this indoor unit of the air conditioner, the opening and closing mechanism has the speed reducing mechanism. In other words, the speed reducing mechanism that transmits the driving force to the first movable panel is provided at the front grill. Consequently, the first movable panel to which the driving force is transmitted by the speed reducing mechanism is positioned with the front grill as a reference rather than the main body casing. Consequently, with this indoor unit of the air conditioner, the mounting accuracy between the front grill and the first movable panel can be improved.

An indoor unit of an air conditioner according to a fifth aspect of the present invention is the indoor unit of the air conditioner according to any one of the first through the fourth aspects, wherein the opening and closing mechanism has a converting mechanism. The converting mechanism converts a rotary motion transmitted from the driving unit to the opening and closing movements of the first movable panel.

With this indoor unit of the air conditioner, the opening and closing mechanism has the converting mechanism. In other words, the converting mechanism that converts the rotary motion transmitted from the driving unit to the opening and closing movements of the first movable panel is provided at the front grill. Consequently, the first movable panel that is opened and closed by the converting mechanism is positioned with the front grill as a reference rather than the main body casing. Consequently, with this indoor unit of the air conditioner, the mounting accuracy between the front grill and the first movable panel can be improved.

An indoor unit of an air conditioner according to a sixth aspect of the present invention is the indoor unit of the air conditioner according to the first through the fifth aspects, wherein the opening and closing mechanism has a first opening and closing mechanism and a second opening and closing mechanism. The first opening and closing mechanism moves one end of the first movable panel by the driving force of the drive portion. The second opening and closing mechanism moves the other end of the first movable panel by the driving force of the drive portion.

With this indoor unit of the air conditioner, the both ends of the first movable panel are moved by the first opening and closing mechanism and the second opening and closing mechanism. Consequently, the first movable panel can be moved in a stable manner.

An indoor unit of an air conditioner according to a seventh aspect of the present invention is the indoor unit of the air conditioner according to the sixth aspect, wherein the first opening and closing mechanism and the second opening and closing mechanism each are formed as a unit.

With this indoor unit of the air conditioner, the first opening and closing mechanism and the second opening and closing mechanism each are formed as a unit. Consequently, with this indoor unit of the air conditioner, the assemblability can be improved.

An indoor unit of an air conditioner according to an eighth aspect of the present invention is the indoor unit of the air conditioner according to the seventh aspect, wherein the first opening and closing mechanism and the second opening and closing mechanism are provided such that they are respectively fixed to inner surfaces of the left and right sides of the front grill.

With this indoor unit of the air conditioner, the first opening and closing mechanism and the second opening and closing mechanism are provided such that they are respectively fixed to the inner surfaces of the left and right sides of the front grill. Consequently, when mounting the front grill, there is a low risk that the first opening and closing mechanism and the second opening and closing mechanism will interfere with the mounting. Consequently, with this indoor unit of the air conditioner, the assemblability can be further improved.

An indoor unit of an air conditioner according to a ninth aspect of the present invention is the indoor unit of the air conditioner according to any one of the sixth through the eighth aspects, wherein the opening and closing mechanism is configured such that it distributes the driving force of the drive portion to the first opening and closing mechanism and the second opening and closing mechanism.

With this indoor unit of the air conditioner, the driving force from the single drive portion can be distributed to the first opening and closing mechanism and the second opening and closing mechanism. Consequently, it is easy to precisely synchronize the opening and closing movements of the first opening and closing mechanism and the second opening and closing mechanism. As a result, with this indoor unit of the air conditioner, the opening and closing movements can be performed in a more stable manner.

An indoor unit of an air conditioner according to a tenth aspect of the present invention is the indoor unit of the air conditioner according to the first through the ninth aspects, wherein the front grill further includes a second opening. In addition, the indoor unit of the air conditioner further comprises a second movable panel. The second movable panel is capable of moving so as to open and close the second opening. Further, the opening and closing mechanism moves the first movable panel to open and close the first opening and also moves the second movable panel to open and close the second opening, by the driving force of the drive portion.

With this indoor unit of the air conditioner, the opening and closing mechanism moves the first movable panel to open and close the first opening and also moves the second movable panel to open and close the second opening, by the driving force of the drive portion. Consequently, it is possible to link the first movable panel and the second movable panel and move them together by the opening and closing mechanism. Consequently, with this indoor unit of the air conditioner, the opening and closing movements of the first movable panel and the second movable panel can be performed in a timely manner.

An indoor unit of an air conditioner according to an eleventh aspect of the present invention is the indoor unit of the air conditioner according to any one of the first through the tenth aspects, wherein the main body casing has a second gear. The second gear is disposed such that it engages with a first gear included in the opening and closing mechanism in a state in which the front grill is mounted to the main body casing, and the second gear transmits the driving force of the drive portion to the opening and closing mechanism.

With this indoor unit of the air conditioner, the second gear is disposed such that it engages with the first gear included in the opening and closing mechanism in the state in which the front grill is mounted to the main body casing, and the second gear transmits the driving force of the drive portion to the opening and closing mechanism. Consequently, mounting the front grill to the main body casing enables the second gear to be engaged with the first gear. Consequently, with this indoor unit of the air conditioner, the assemblability can be improved.

An indoor unit of an air conditioner according to a twelfth aspect of the present invention is the indoor unit of the air conditioner according to the first through the eleventh aspects, wherein the main body casing is provided with a control component. In addition, the drive portion has a motor that is connected to the control component and that moves the first movable panel. In addition, the main body casing has a temporary fixing portion, with which the drive portion is temporarily fixed. Further, the front grill has a fixing portion with which the temporarily fixed drive portion is fixed.

Some indoor units of air conditioners are provided with a movable panel that moves by a driving force of a motor in a casing, and the motor is connected to a control component and is controlled by the control component. With an indoor unit of an air conditioner, in which a casing is divided into a main body casing and a front grill, a control component is housed in the main body casing, and the front grill is provided with a movable panel (refer to Japanese Laid-Open Patent Application No. 2003-21495 (third Figure)), in order to have a front panel function as a movable panel, such structures as one by which a drive portion having a motor is fixed to the main body casing and one by which a drive portion is fixed to the front grill may be conceivable.

However, in case of the structure in which the drive portion is fixed to the main body casing, there is a risk that the assembly accuracy of the indoor unit of the air conditioner will be reduced. In other words, in the case where the drive portion to move the movable panel is fixed to the main body casing and the movable panel is provided at the front grill, the alignment between the drive portion and the movable panel will be difficult, and it will easily generate an error in the assembly accuracy between the main body casing and the front grill.

In addition, in case of the structure in which the drive portion is fixed to the front grill, there is a risk that the wiring procedure will be difficult. In other words, since the drive portion has the motor, it needs to be connected to the control component. However, since the control component is housed in the main body casing, in the case where the drive portion is fixed to the front grill, the wiring will extend from the main body casing to the front grill. Consequently, there is a risk that the wiring procedure will be complicated and difficult.

With this indoor unit of the air conditioner, the drive portion can be temporarily fixed to the main body casing. As a result, the wiring procedure for connecting the control component and the drive portion can be prevented from becoming complicated. In addition, the drive portion that is temporarily fixed to the main body casing can be fixed to the front grill after the front grill is mounted to the main body casing. As a result, the alignment between the drive portion and the front grill will be easy, and the assembly accuracy among the main body casing, the front grill, and the drive portion can be improved. As discussed above, with this indoor unit of the air conditioner, the assembly accuracy can be improved, and also the wiring procedure can be easily conducted.

An indoor unit of an air conditioner according to a thirteenth aspect of the present invention is the indoor unit of the air conditioner according to the twelfth aspect, wherein the drive portion is temporarily fixed such that the drive portion is capable of moving to a position where the drive portion is to be fixed with the fixing portion when the drive portion is fixed with the fixing portion.

With this indoor unit of the air conditioner, the drive portion is temporarily fixed such that the drive portion is capable of moving to a position where the drive portion is to be fixed with the fixing portion when the drive portion is fixed with the fixing portion. Consequently, with this indoor unit of the air conditioner, it will be easy to align the drive portion with the front grill.

An indoor unit of an air conditioner according to a fourteenth aspect of the present invention is the indoor unit of the air conditioner according to the twelfth or the thirteenth aspect, wherein the temporary fixing portion has a clip portion which holds the drive portion and temporarily fixes the drive portion.

With this indoor unit of the air conditioner, the drive portion is temporarily fixed with the clip portion. Consequently, with this indoor unit of the air conditioner, the temporary fixation can be achieved by a simple component such as the clip portion.

BRIEF DESCRIPTION OF THE DRAWINGS

FIG. 3(*b*) is a side cross sectional view of the indoor unit.

DETAILED DESCRIPTION OF THE INVENTION

Entire Configuration of the Air Conditioner

Figure 1:
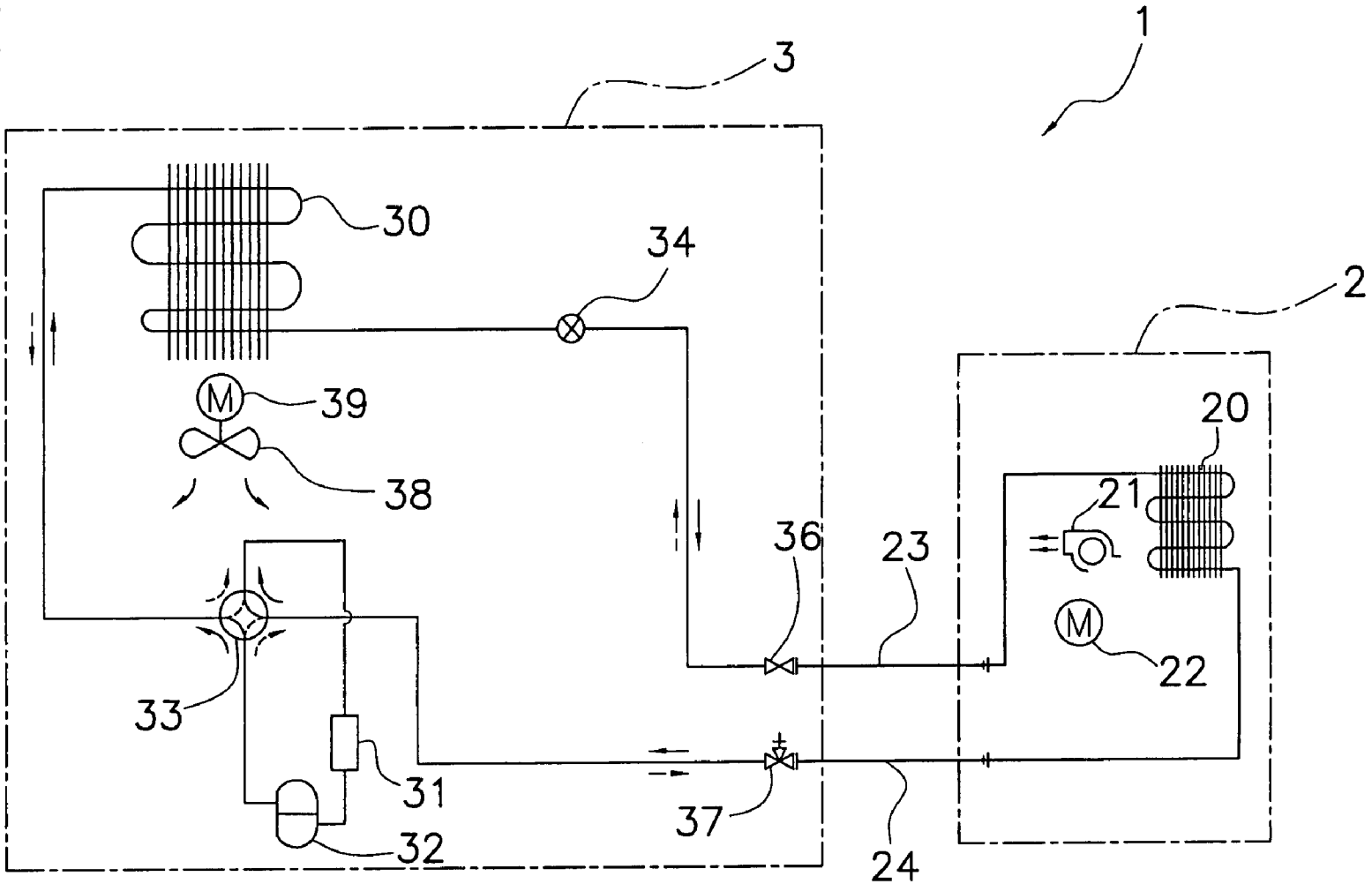
FIG. 1 is a view of a refrigerant circuit of an air conditioner.

FIG. 1 shows a schematic view of the configuration of an air condition 1 and a refrigerant circuit thereof according to a first embodiment of the present invention.

This air conditioner 1 comprises an indoor unit 2, which is attached to a wall surface or the like in the room, and an outdoor unit 3 installed outdoors.

This refrigerant circuit of this air conditioner 1 mainly comprises an indoor heat exchanger 20, an accumulator 31, a compressor 32, a four-way switching valve 33, an outdoor heat exchanger 30, and a motor-operated expansion valve 34.

The indoor heat exchanger 20 provided inside the indoor unit 2 exchanges heat with the air with which it comes in contact. In addition, the indoor unit 2 is provided with an indoor fan 21 that draws in the indoor air, passes the air through the indoor heat exchanger 20 for heat exchange, and then discharges the air into the room. The indoor fan 21 is rotatably driven by an indoor fan motor 22 provided inside the indoor unit 2. The configuration of the indoor unit 2 will be described in detail later.

The outdoor unit 3 comprises the compressor 32, the four-way switching valve 33 connected to a discharge side of the compressor 32, the accumulator 31 connected to an intake side of the compressor 32, the outdoor heat exchanger 30 connected to the four-way switching valve 33, and the motor-operated expansion valve 34 connected to the outdoor heat exchanger 30. The motor-operated expansion valve 34 is connected to a pipe 23 via a liquid shutoff valve 36, and is connected to one end of the indoor heat exchanger 20 via this pipe 23. In addition, the four-way switching valve 33 is connected to a pipe 24 via a gas shutoff valve 37, and is connected to the other end of the indoor heat exchanger 20 via this pipe 24. In addition, the outdoor unit 3 is provided with an outdoor fan 38 for externally discharging air after its heat has been exchanged by the outdoor heat exchanger 30. The outdoor fan 38 is rotatably driven by an outdoor fan motor 39.

<Configuration of the Indoor Unit>

Figure 2:
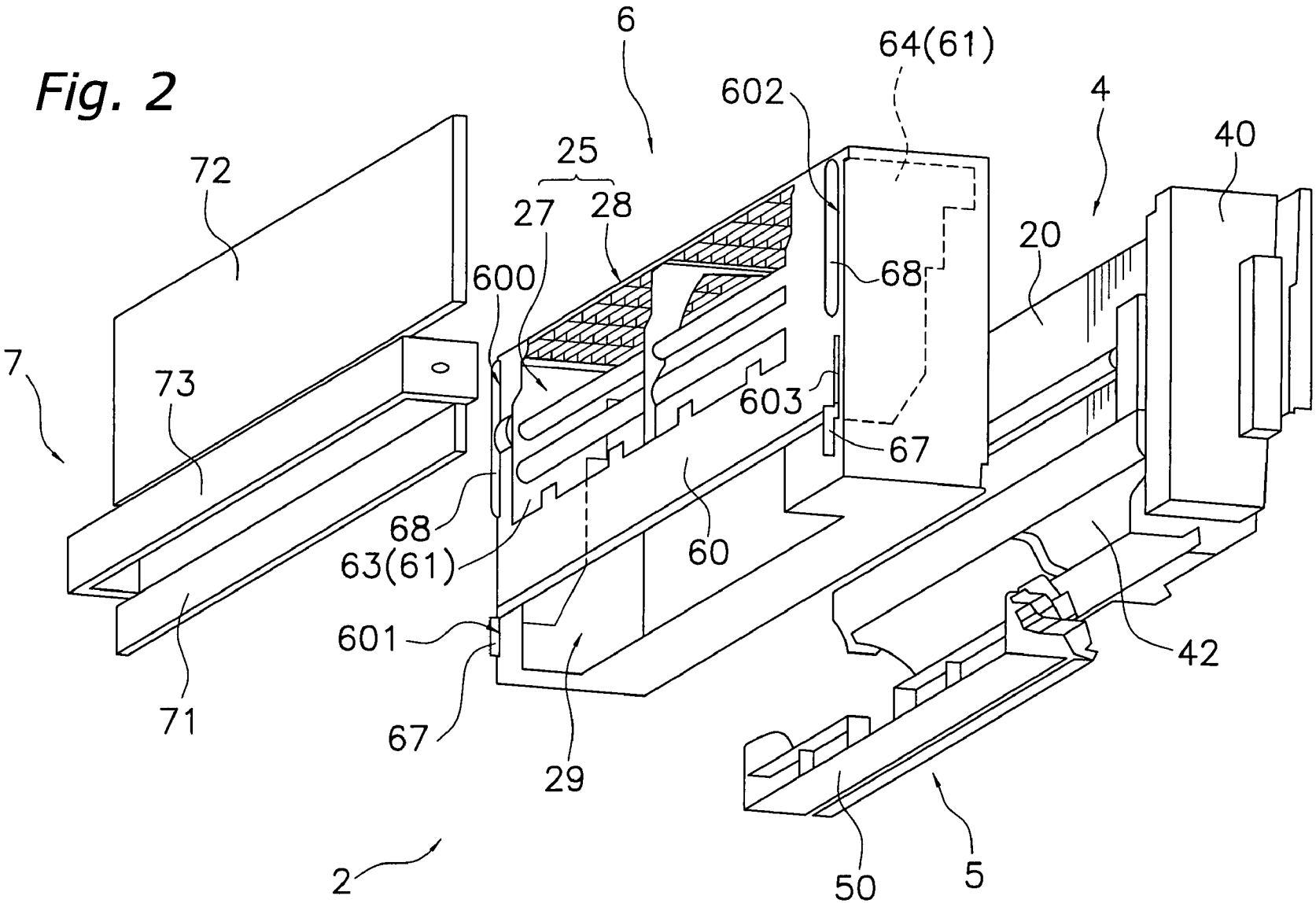
FIG. 2 is an exploded perspective view of an indoor unit.

FIG. 2 shows an exploded perspective view of the indoor unit 2.

The indoor unit 2 is a wall-hanging type indoor unit, which is installed on a side wall of the room, and the indoor unit 2 mainly comprises a main body part 4, an outlet assembly 5, a front grill assembly 6, and a front panel 7.

<Main Body Part>

The main body part 4 has the indoor heat exchanger 20, the indoor fan 21 (refer to FIG. 1), the indoor fan motor 22 (refer to FIG. 1), an electrical component box 40, a driving machine 41 (refer to FIG. 4), and a main body casing 42.

<Indoor Heat Exchanger, Indoor Fan, Indoor Fan Motor, Electrical Component Box>

Figure 3B:
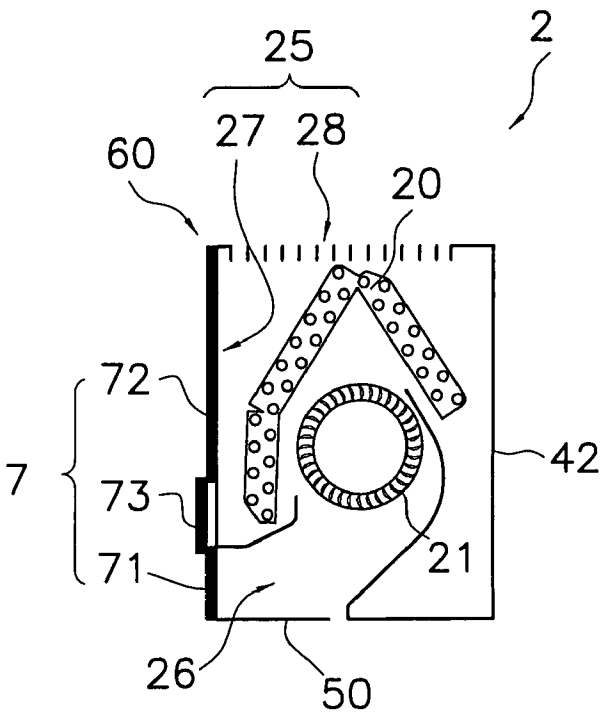
FIG. 3(*a*) is a front view of the indoor unit.
Figure 3A:
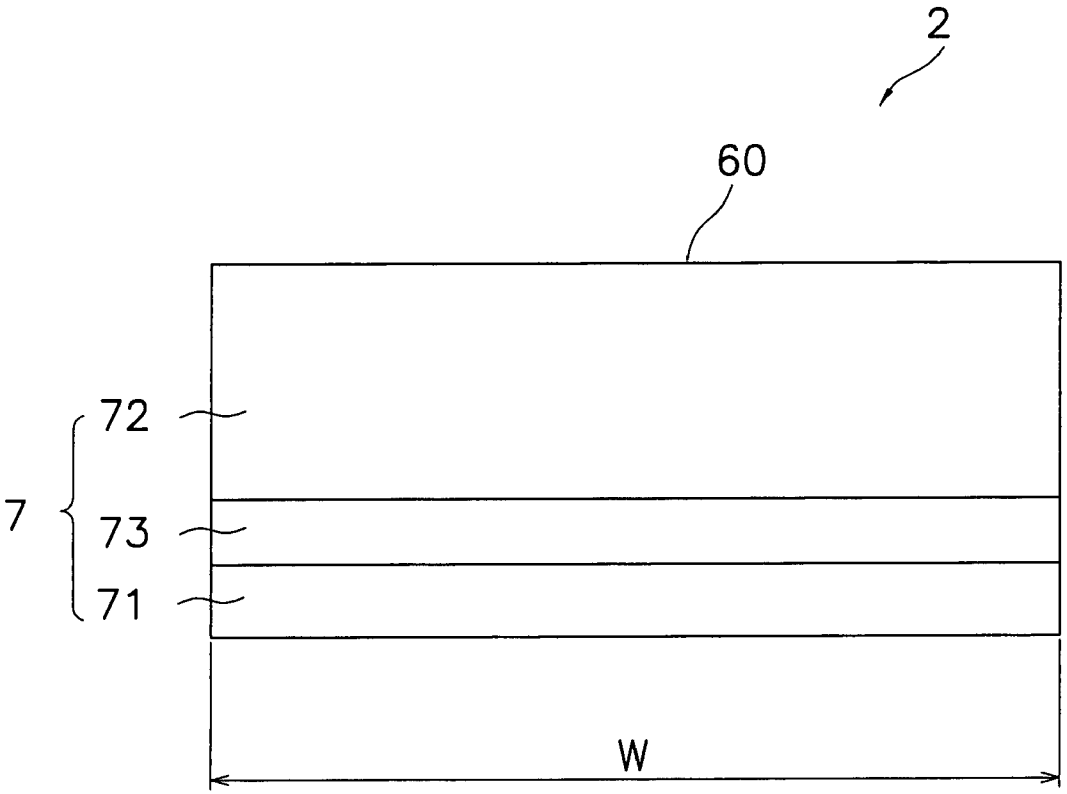

The indoor heat exchanger 20, the indoor fan 21, and the indoor fan motor 22 are mounted to the main body casing 42. As shown in FIG. 3(*b*), as for the indoor heat exchanger 20 and the indoor fan 21 in the side view, the indoor fan 21 is disposed in the center of the indoor unit 2, and the indoor heat exchanger 20 having an inverted V-shape is disposed such that it covers an upper half of the indoor fan 21. In addition, the indoor fan motor 22 (not shown) is disposed to a right side of the indoor fan 21 in the front view. Note that FIG. 3(*b*) is a side cross sectional view of the indoor unit 2.

As shown in FIG. 2, the electrical component box 40 is mounted to the main body casing 42, and is disposed to the right side of the indoor heat exchanger 20, the indoor fan 21, and the indoor fan motor 22 in the front view. The electrical component box 40 houses a control board therein, and the control board controls each component that is necessary for heating and cooling operations and the like of the indoor unit 2.

<Driving Machine>

Figure 4:
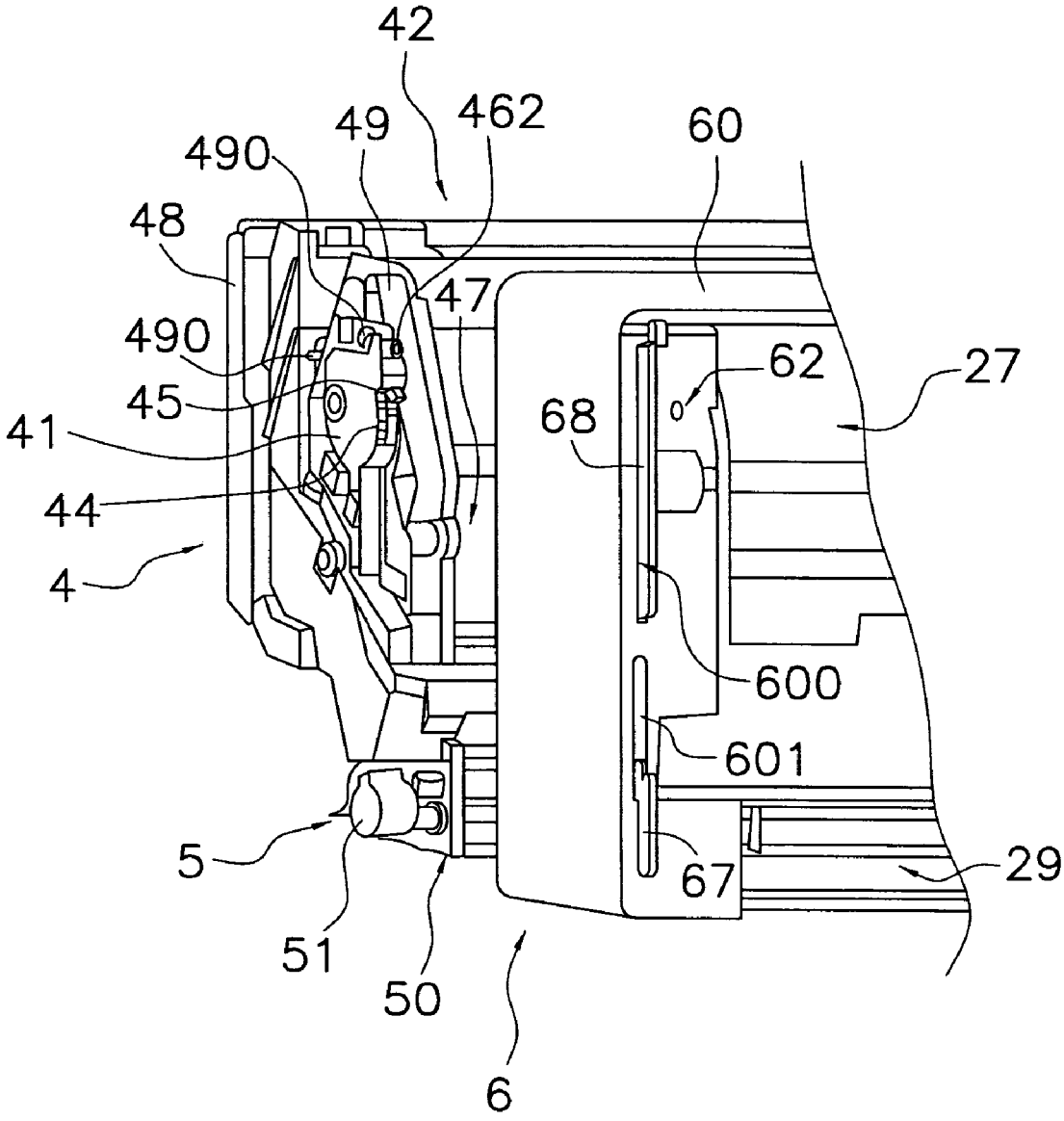
FIG. 4 is an exploded perspective view showing the vicinity of a left side end of the indoor unit.
Figure 5:
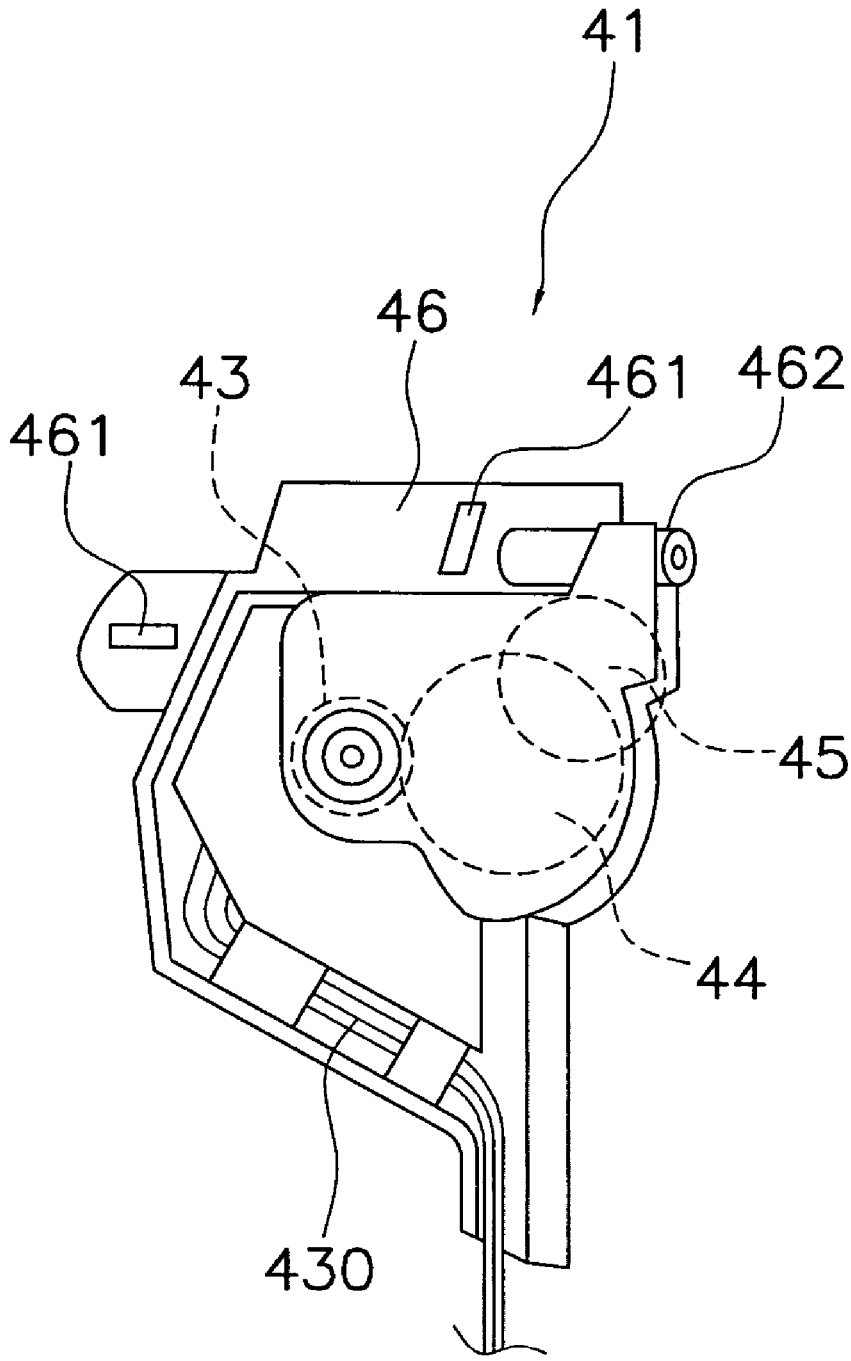
FIG. 5 is a side view of a driving machine.

As shown in FIG. 4, the driving machine 41 (drive portion) is disposed near a left side end of the main body casing 42, and generates a driving force to move the front panel 7. As shown in FIG. 5, the driving machine 41 includes a panel opening and closing motor 43 (motor), a first drive gear 44, a second drive gear 45 (second gear), and a drive casing 46.

The panel opening and closing motor 43 is connected to a control component housed in the electrical component box 40 via a cable 430, and serves as a source of the driving force to move the front panel 7.

The first drive gear 44 transmits the rotation of the panel opening and closing motor 43 to the second drive gear 45.

The second drive gear 45 has a portion that is exposed from the drive casing 46, and is disposed so as to engage with a power transmission gear 66 (refer to FIG. 6) included in an opening and closing mechanism 61, in a state in which a front grill 60 is mounted to the main body casing 42. Consequently, by mounting the front grill 60 to the main body part 4 and fixing the driving machine 41 to a later described fixing portion 62 (refer to FIG. 4), the second drive gear 45 can be easily engaged with the power transmission gear 66. The second drive gear 45 transmits the rotation of the panel opening and closing motor 43 via the first drive gear 44 to the power transmission gear 66, and transmits the driving force of the panel opening and closing motor 43 to the opening and closing mechanism 61.

The drive casing 46 houses the above mentioned panel opening and closing motor 43, the first drive gear 44, and the second drive gear 45. In addition, the drive casing 46 includes a locking hole 461 and a fixed portion 462.

The locking hole 461 is an opening, which is provided in the drive casing 46, and to which a locking clip 490 on the main body casing 42 shown in FIG. 4 will be inserted. Two locking holes 461 are provided in the drive casing 46, and each of them is formed larger than the locking clip 490. Consequently, in a state in which the locking clips 490 are inserted to the locking holes 461, the driving machine 41 is not completely fixed in an unmovable manner, but the driving machine 41 is temporarily fixed in a slightly movable manner. Therefore, when regularly fixing the driving machine 41, which is conducted after the temporary fixation, the driving machine 41 can be easily positioned.

The fixed portion 462 is a portion configured to be fixed to the fixing portion 62 of the front grill 60, and it has a screw hole. The fixed portion 462 is screwed to the fixing portion 62 provided at the front grill 60. Unlike the temporary fixation between the locking hole 461 and the locking clip 490, the fixation between the fixed portion 462 and the fixing portion 62 is a fixation to securely fix the driving machine 41 to the front grill 60 to prevent the driving machine 41 from moving.

<Main Body Casing>

The main body casing 42 is provided with the indoor heat exchanger 20, the indoor fan 21, the indoor fan motor 22, the electrical component box 40, and the driving machine 41. The indoor heat exchanger 20, the indoor fan 21, the indoor fan motor 22, and the electrical component box 40 are fixed to the main body casing 42, and the driving machine 41 is temporarily fixed thereto. The main body casing 42 is molded from a resin material and has a shape such that it covers lower and back portions and the left side portion of the indoor fan 21. As shown in FIG. 4, the main body casing 42 includes an indoor fan housing 47, a back portion 48, and a left side portion 49. Note that in FIG. 4, views of the indoor heat exchanger 20 and the indoor fan 21 are omitted in order to facilitate understanding.

The indoor fan housing 47 is a portion that houses the indoor fan 21 and the indoor fan motor 22, and the indoor fan housing 47 supports the indoor heat exchanger 20 that is mounted from above the indoor fan 21. The indoor fan motor 22 to be disposed to the right side of the indoor fan 21 is fixed to a portion near a right side end of the indoor fan housing 47, and the electrical component box 40 is fixed to the further right side thereof (refer to FIG. 2). A lower portion of the indoor fan housing 47 is a portion to which the outlet assembly 5 is fixed, and the lower portion is provided with an opening (not shown) which communicates with a space in which the indoor fan 21 housed. As a result of mounting the outlet assembly 5 to the lower portion of the indoor fan housing 47, the space of the indoor fan housing 47, in which the indoor fan 21 is housed, will communicate with the outlet 26 (refer to FIG. 3(*b*)).

The back portion 48 covers the back of the indoor fan 21 and the indoor heat exchanger 20, and closes a backside of the indoor unit 2.

The left side portion 49 is a portion to which the driving machine 41 will be temporarily fixed. The left side portion 49 is provided near a left side end of the indoor fan housing 47, and is disposed such that it faces left side ends of the indoor fan 21 and the indoor heat exchanger 20, which are mounted to the indoor fan housing 47. A left side surface of the left side portion 49 is provided with the locking clip 490, with which the driving machine 41 is temporarily fixed. Two locking clips 490 are provided to correspond to the locking holes 461, and the locking clips 490 protrude from the left side surface of the left side portion 49 to the left, in other words, the locking clips 490 protrudes from the left side portion 49 to the side opposite the indoor fan 21. The driving machine 41 is temporarily fixed to the main body casing 42 with the locking clips 490, before the front grill 60 is mounted to the main body casing 42. Each locking hole 461 in the driving machine 41, to which each locking clip 490 will be inserted, is formed larger than the locking clip 490 as described above. Consequently, the driving machine 41, which is in a state of being temporarily fixed with the locking clips 490 and the locking holes 461, is temporarily fixed in a slightly movable manner. When the driving machine 41 is fixed with the fixing portion 62 of the later described front grill 60, the driving machine 41 is temporarily fixed with the locking clip 490 such that the driving machine 41 is capable of moving to a position where the driving machine 41 will be fixed with the fixing portion 62.

<Outlet Assembly>

The outlet assembly 5 shown in FIG. 2 is mounted to the main body part 4 and configures the outlet 26 (refer to FIG. 3 (*b*)). The outlet 26 configured by the outlet assembly 5 is an opening wherethrough passes the air that is passed through the indoor heat exchanger 20 and is blown out into the room by the indoor fan 21. The outlet 26 has a horizontally long shape in the front view. In addition, the outlet 26 is disposed near a lower portion of the indoor unit 2 and at the front of the indoor unit 2. When the indoor unit 2 is shut down, the outlet 26 is closed by a first panel 71 (second movable panel) of the front panel 7, which will be described later.

The outlet assembly 5 has a horizontal flap 50 and a flap motor 51 (refer to FIG. 4). The horizontal flap 50 has a plate-like shape that is long in the longitudinal direction of the indoor unit 2, and guides the air that is blown out from the outlet 26. The horizontal flap 50 has a rotation axis that is parallel to the longitudinal direction of the indoor unit 2, and by being driven by the flap motor 51 and rotated about the rotation axis, the horizontal flap 50 changes the air direction in which the air is guided. In addition, by moving so as to be parallel to the horizontal plane, the horizontal flap 50 configures the base of the indoor unit 2, with the base being parallel to the horizontal plane.

<Front Grill Assembly>

The front grill assembly 6 is mounted to the main body part 4 from the front, and covers the front and side surfaces of the main body part 4. The front grill assembly 6 has the front grill 60 and the opening and closing mechanism 61.

<Front Grill>

The front grill 60 is molded from a resin material, and has a shape that is thin and a generally rectangular parallelepiped with the entire backside open. The front grill 60 has a shape that is horizontally long and generally rectangular in the front view, and has a cross-sectional shape that is long in an up and down direction and generally rectangular in the side view. The front grill 60 is mounted to the main body part 4 such that it covers a front portion, left and right side portions, and upper and lower portions of the main body part 4. In addition, the front grill 60 is provided with the intake portion 25 and the outlet portion 29 (second opening).

The intake portion 25 is provided with an opening wherethrough passes the air that is drawn in from inside the room into the indoor unit 2 by the indoor fan 21, and the intake portion 25 has a first intake port 27 (first opening) and a second intake port 28. The first intake port 27 is provided across a portion from near the center of the front of the front grill 60 to a top portion thereof, and is disposed such that it faces a front side of the indoor heat exchanger 20. When the indoor unit 2 is shut down, the first intake port 27 is closed by a second panel 72 (first movable panel) of the front panel 7, which will be described later. The second intake port 28 is configured by a plurality of slits that are long in the longitudinal direction of the front grill 60, and is provided at the top of the front grill 60.

The outlet portion 29 is an opening provided at a lower portion of the front grill 60, and together with the outlet assembly 5, the outlet portion 29 configures the outlet 26. The outlet portion 29 is closed by the first panel 71 of the front panel 7, which will be described later.

In addition, as shown in FIG. 4, the fixing portion 62 is provided at the front of the front grill 60. The fixing portion 62 is a portion where the fixed portion 462 of the temporarily fixed driving machine 41 will be fixed, and the fixing portion 62 has a screw hole. The screw hole is provided near a left side end of the front of the front grill 60, and is disposed at a position which generally faces a screw hole in the fixed portion 462 of the driving machine 41 that is being temporarily fixed to the main body part 4. However, in the temporary fixation step, the screw hole in the fixed portion 462 and the screw hole in the fixing portion 62 do not have to completely coincide with each other. Instead, in the regular fixation step in which the fixed portion 462 and the fixing portion 62 are fixed, the driving machine 41 being temporarily fixed can simply be moved such that the screw hole in the fixed portion 462 will coincide with the screw hole in the fixing portion 62. The fixing portion 62 and the fixed portion 462 are fixed by threading a screw through the screw hole in the fixed portion 462 and the screw hole in the fixing portion 62.

At portions near both sides ends of the front of the front grill 60, there are provided slits 600 to 603 that extend in an up and down direction. These slits 600 to 603 are disposed such that there are a total of four, two on the left and two on the right, separated above and below. Protruding from these slits 600 to 603 are portions of a first panel supporting member 67 and a second panel supporting member 68, which will be described later. The first panel 71 and the second panel 72 of the front panel 7 are respectively fixed to the above mentioned portions of the first panel supporting member 67 and the second panel supporting member 68.

<Opening and Closing Mechanism>

Figure 6:
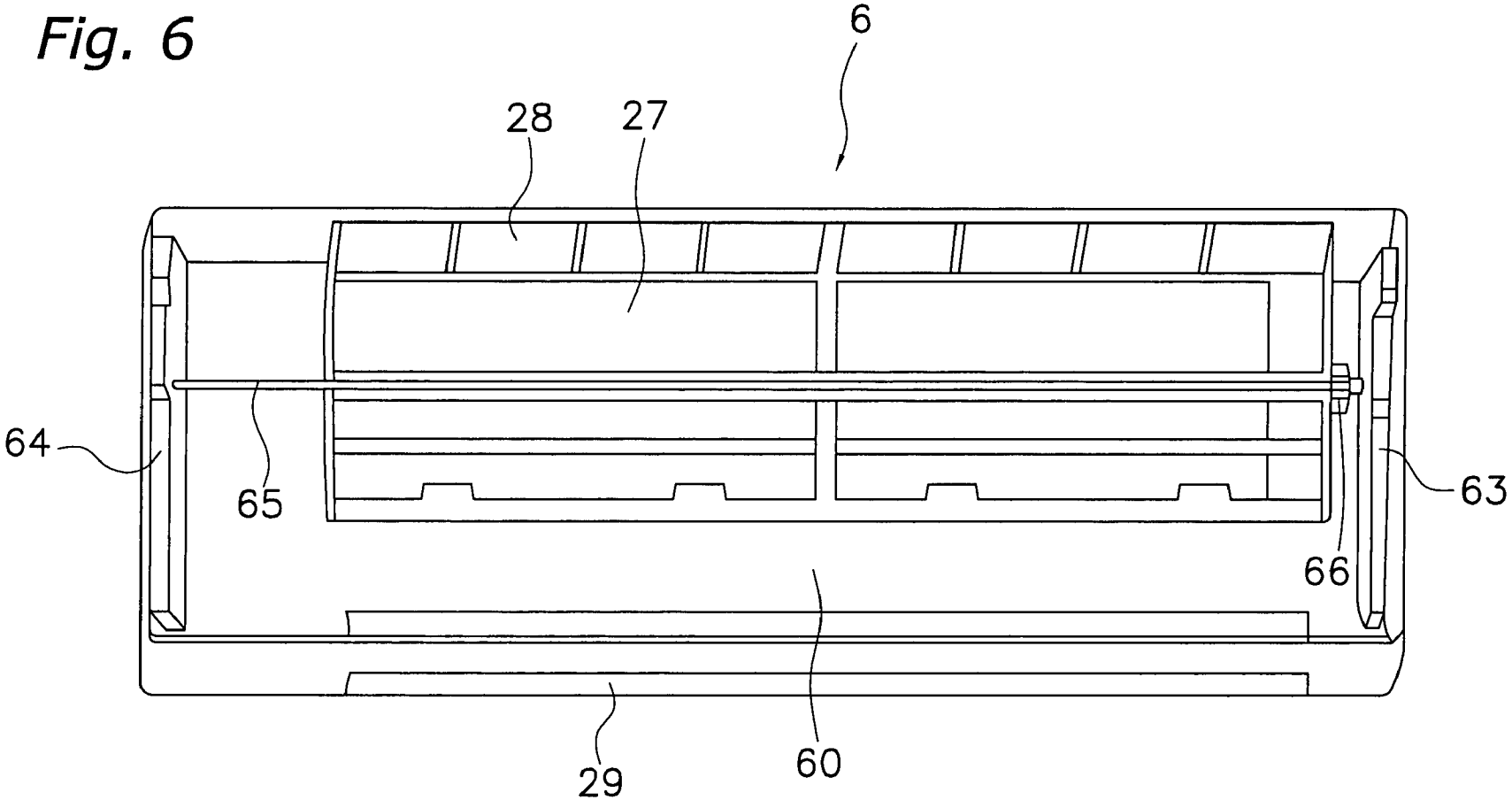
FIG. 6 is a view of a front grill assembly seen from the reverse side.

The opening and closing mechanism 61 shown in FIG. 2 is a mechanism for moving the front panel 7 by the driving force of the driving machine 41 to open and close the first intake port 27 and the outlet 26. The opening and closing mechanism 61 is configured by a plurality of members having a gear portion. The opening and closing mechanism 61 functions as a speed reducing mechanism that transmits the driving force of the driving machine 41 to the first panel 71 and the second panel 72. In addition, the opening and closing mechanism 61 functions as a converting mechanism that converts a rotary motion transmitted from the driving machine 41 into the opening and closing movements of the first panel 71 and the second panel 72. As shown in FIG. 6, the opening and closing mechanism 61 is provided at the back of the front grill 60, and has a first opening and closing mechanism 63, a second opening and closing mechanism 64, and a power transmission shaft 65.

The first opening and closing mechanism 63 is mounted to the back of the left side surface of the front panel 7, and supports a portion near a left side end of the first panel 71 and a portion near a left side end of the second panel 72, which will be described later. Note that the "left-right" here means the "left-right" when the indoor unit 2 is seen in the front view, and since FIG. 6 shows the front grill 60 seen from the reverse side, the left-right in FIG. 6 is reversed from that in the front view. When opening and closing the first panel 71 and the second panel 72, the first opening and closing mechanism 63 transmits the driving force of the driving machine 41 to the portion near the left side end of the first panel 71 and to the portion near the left side end of the second panel 72, so that these portions will move. This will result in the opening and closing movements of the first panel 71 and the second panel 72.

The second opening and closing mechanism 64 is mounted to the back of a right side surface of the front panel 7, and supports a portion near a right side end of the first panel 71 and a portion near a right side end of the second panel 72, which will be described later. When opening and closing the first panel 71 and the second panel 72, the second opening and closing mechanism 64 transmits the driving force of the driving machine 41 to the portion near the right side end of the first panel 71 and to the portion near the right side end of the second panel 72, so that these portions will move. This will result in the opening and closing movements of the first panel 71 and the second panel 72.

The power transmission shaft 65 is a member for distributing and transmitting the driving force of the driving machine 41 to the first opening and closing mechanism 63 and the second opening and closing mechanism 64. The power transmission shaft 65 is mounted to the back of the front of the first front grill 60 such that it can freely rotate about an axis that is parallel to the longitudinal direction of the indoor unit 2. Both ends of the power transmission shaft 65 are respectively connected to the first opening and closing mechanism 63 and the second opening and closing mechanism 64, and the power transmission gear 66 (first gear) is provided therebetween. The power transmission gear 66 is provided near the first opening and closing mechanism 63, and is disposed such that it engages with the second drive gear 45 of the driving machine 41 in a state in which the front grill 60 is mounted to the main body part 4. In this way, the opening and closing mechanism 61 is configured such that it distributes, by the power transmission shaft 65, the driving force of driving machine 41 to the first opening and closing mechanism 63 and the second opening and closing mechanism 64.

The configuration of the first opening and closing mechanism 63 is described in detail below; it should be noted that the structure of the second opening and closing mechanism 64 is symmetric to that of the first opening and closing mechanism 63.

Figure 7:
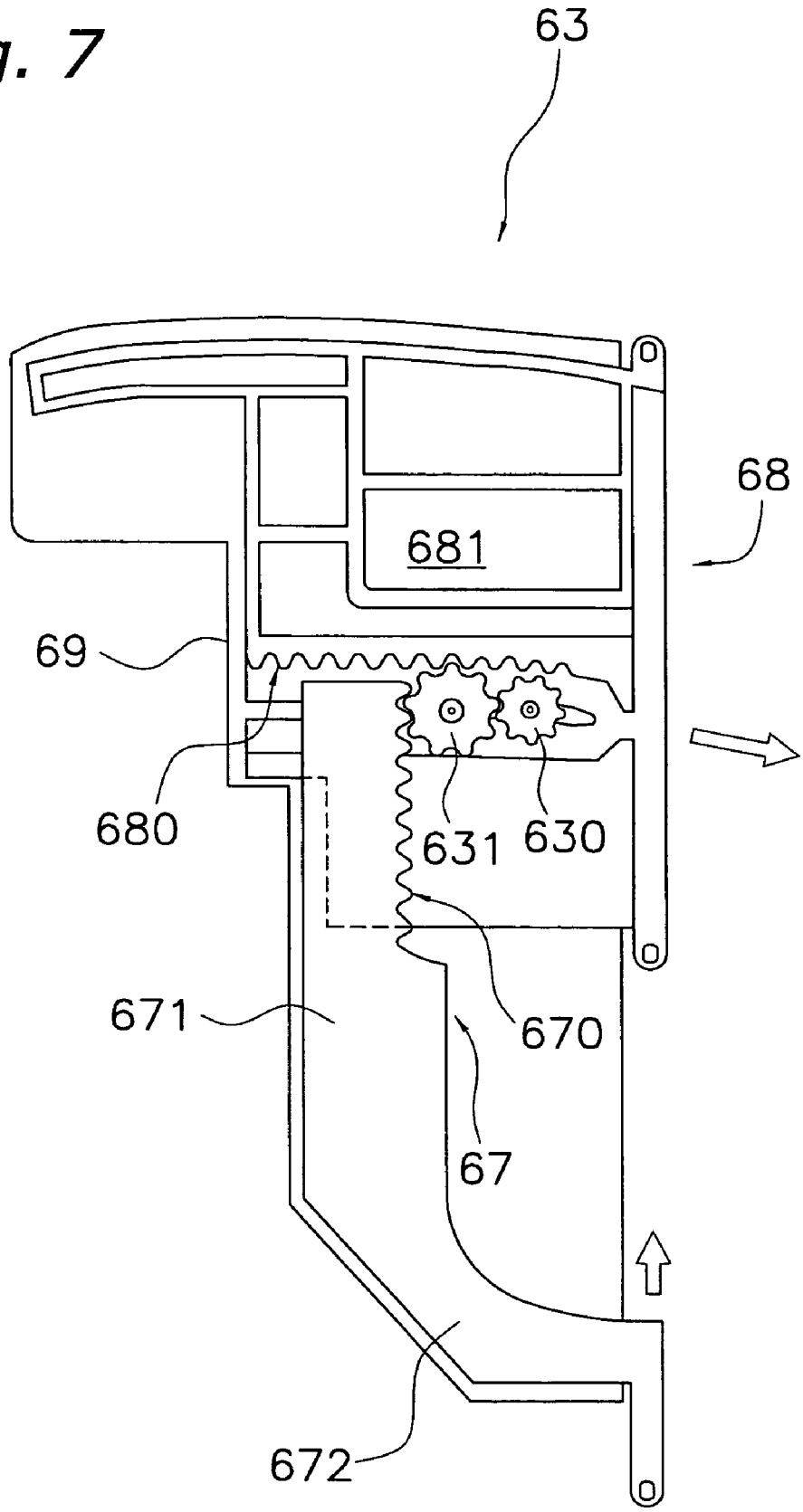
FIG. 7 is a side view of a first opening and closing mechanism.

As shown in FIG. 7, the first opening and closing mechanism 63 has a first opening and closing gear 630 (speed reducing mechanism, converting mechanism), a second opening and closing gear 631 (speed reducing mechanism, converting mechanism), and the first panel supporting member 67, and the second panel supporting member 68 (supporting member, speed reducing mechanism, converting mechanism). In addition, the first opening and closing mechanism 63 has a first opening and closing mechanism casing 69 for housing these gears and members, and is formed as a unit.

The first opening and closing gear 630 is fixed to an end of the power transmission shaft 65, and transmits the driving force of the driving machine 41, which is transmitted via the power transmission shaft 65, to the second opening and closing gear 631.

The second opening and closing gear 631 engages with the first opening and closing gear 630, a first gear portion 670 of the first panel supporting member 67, and a second gear portion 680 of the second panel supporting member 68, and transmits the driving force transmitted from the first opening and closing gear 630 to both the first panel supporting member 67 and second panel supporting member 68.

The first panel supporting member 67, which is mounted to the first panel 71, is a flat plate shape member that supports the first panel 71. The first panel supporting member 67 is provided such that it can move in an up and down direction, and it is capable of moving the first panel 71 linearly in an up and down direction. The first panel supporting member 67 has a straight portion 671 in a linear shape, which extends parallel to an up and down direction, and a curved portion 672, which curves from a lower portion of the straight portion 671 toward the front of the indoor unit 2. Also, the curved portion 672 has a tip portion that protrudes forward of the front grill 60 through the slit 601 provided at the front of the front grill 60 (refer to FIG. 4). To this tip potion of the curved portion 672 is fixed the portion near the left side end of the first panel 71. In addition, at the straight portion 671, there is provided the first gear portion 670. The first gear portion 670 is a rack gear that extends in an up and down direction, and converts a rotary motion of the second opening and closing gear 631 to a linear motion in an up and down direction. As a result, the rotary motion of the driving machine 41 is converted to the linear motion of the first panel 71 in an up and down direction.

The second panel supporting member 68, which is mounted to the second panel 72, is a flat plate shape member that supports the second panel 72. The second panel supporting member 68 is provided such that it can move in a front and back direction, and it is capable of moving the second panel 72 in a front and back direction. In detail, the second panel supporting member 68 draws a gentle circular arc as it moves in a front and back direction. In other words, when the second panel 72 moves forward, the second panel 72 moves such that its upper end leans forward, whereas when the second panel 72 moves backward, the second panel 72 moves such that the upper end leaning forward will return to its original position and the second panel 72 becomes parallel to an up and down direction (refer to FIG. 8). The second panel supporting member 68 is integrally molded from a resin material, and has the second gear portion 680 and a plate member 681.

The second gear portion 680 is provided such that it protrudes from inside the plate member 681, and it engages with the second opening and closing gear 631. The second gear portion 680 is a rack gear that extends in a front and back direction drawing a gentle circular arc. The second gear portion 680 converts the rotary motion of the second opening and closing gear 631 to a circular arc motion and transmits the driving force of the driving machine 41 to the second panel 72.

The plate member 681 is provided at the outer sides (left sides) of the first opening and closing gear 630, the second opening and closing gear 631, and the first panel supporting member 67. The plate member 681 covers the outer sides of the first opening and closing gear 630, the second opening and closing gear 631, and the first panel supporting member 67. A front end of the plate member 681 protrudes forward through the slit 600 that is provided at a front surface of the front panel 7. To this front end is fixed the portion near the left side end of the second panel 72 and thereby the portion near the left side end of the second panel 72 is supported. The plate member 681 moves such that it draws a gentle circular arc as mentioned above by the driving force of the driving machine 41 transmitted to the second gear portion 680. As for the opening movement of the second panel 72, the plate member 681 moves the second panel 72 away from the first intake port 27 by further protruding from the slit 600 forward of the front grill 60. Specifically, as for the open state of the second panel 72, the plate member 681 protrudes greatly from the slit 600 forward of the front grill 60 and covers sides of a gap between the second panel 72 and the front grill 60 (refer to FIG. 8). As a result, the plate member 681 can prevent a room occupant from inserting his or her hand into the gap between the second panel 72 and the front grill 60 from a side of the gap. In addition, since the plate member 681 is located at the outer sides of the second gear portion 680, the first opening and closing gear 630, the second opening and closing gear 631, and the like, a room occupant is prevented from touching the second gear portion 680, the first opening and closing gear 630, the second opening and closing gear 631, and the like, with his or her hand.

<Front Panel>

As shown in FIG. 3(*a*), a front panel 7 covers generally the entire front of the front grill 60. The front panel 7 covers the outlet 26 and the first intake port 27 in the front view, and opens and closes the outlet 26 and the first intake port 27. The front panel 7 is a panel assembly, which is an aggregation of a plurality of seamless panels, and the front panel 7 has the first panel 71, the second panel 72, and a third panel 73.

<First Panel>

The first panel 71 is movably disposed at the front lower portion of the front grill 60 so as to open and close the outlet 26, and the first panel 71 is disposed such that it covers the outlet 26. The first panel 71 is supported at the portions near both right and left ends thereof by the opening and closing mechanism 61 such that it can move parallel to an up and down direction, and the first panel 71 opens and closes the outlet 26. The first panel 71 is a member in a rectangular, flat plate shape without a seam, and the width thereof is substantially equal to the width W of the front grill 60 in the front view. The front side of the first panel 71 is formed in a generally flat shape with a smooth texture without a concave or convex portion, opening such as a hole, or the like. This first panel 71 will be parallel to an up and down direction as shown in FIG. 3(*a*) and FIG. 8(*a*) in a state in which the outlet 26 is closed by the first panel 71. In addition, in this state, the first panel 71 has a projected area that is larger than the outlet 26 in the front view. Consequently, the first panel 71 completely covers the front lower portion of the front grill 60 including the outlet 26, in the state in which the outlet 26 is closed by the first panel 71. In addition, the first panel 71 is molded from a transparent resin mixed with luminous particles such as pearl particles, and the first panel 71 has a transparent resin layer mixed with such particles. Also, on the back of the transparent resin layer, there is provided a paint layer to which a color scheme, pattern, and the like are applied. This paint layer is formed by applying paint on the back of the first panel 71. In this way, the first panel 71 has a highly attractive design. By being disposed at the front where it is easily seen by a room occupant, the first panel 71 functions as a design panel which enhances the design of the indoor unit 2.

<Second Panel>

The second panel 72 is formed as a separate body from the first panel 71. The second panel 72 is movably disposed at a front upper portion of the front grill 60 so as to open and close the first intake port 27, and the second panel 72 is disposed such that it covers the first intake port 27. The second panel 72 is supported at the portions near both the right and left ends thereof by the opening and closing mechanism 61 such that it can move in a front and back direction. The second panel 72 opens the first intake port 27 by moving away from the first intake port 27 and closes the first intake port 27 by moving close to the first intake port 27. The second panel 72 is a member in a rectangular, flat plate shape without a seam, and in the front view, the width thereof is substantially equal to the width W of the front grill 60 including the first intake port 27. The front side of the second panel 72 is formed in a generally flat shape with a smooth texture without a concave or convex portion, opening such as a hole, or the like. This second panel 72 will be parallel to an up and down direction as shown in FIG. 3(*a*) and FIG. 8(*a*), in a state in which the first intake port 27 is closed by the second panel 72. In addition, the second panel 72 has a projected area that is larger than the first intake port 27 in the front view. Consequently, the second panel 72 covers the front upper half portion of the front grill 60 including the first intake port 27, in the state in which the first intake port 27 is closed by the second panel 72. In addition, as in the case with the first panel 71, the second panel 72 is molded from a transparent resin mixed with luminous particles such as pearl particles, and the first panel 71 has a transparent resin layer mixed with such particles. Also, on the back of the transparent resin layer, there is provided a paint layer to which a color scheme, pattern, and the like are applied. This paint layer is formed by applying paint on the back of the second panel 72. In this way, the second panel 72 has a highly attractive design. By being disposed at the front where it is easily seen by a room occupant, the second panel 72 functions as a design panel which enhances the design of the indoor unit 2.

<Third Panel>

Figure 8C:
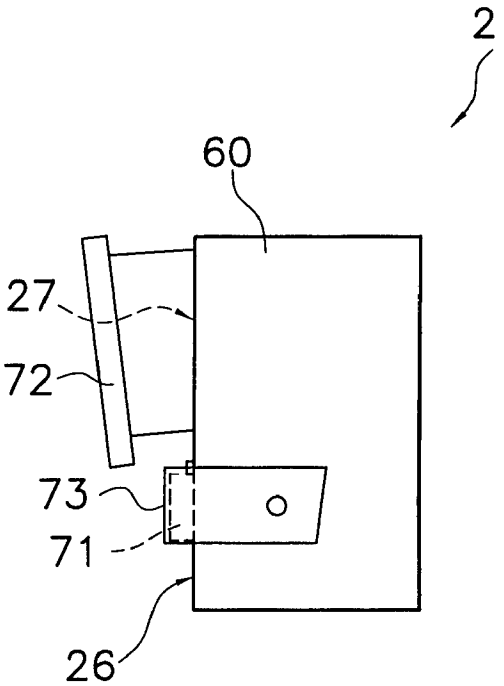
FIG. 8 is a view showing the opening and closing movements of a first panel and a second panel.
Figure 8B:
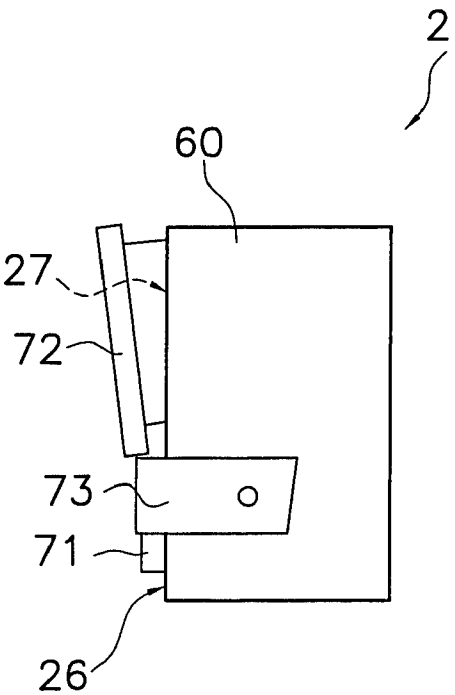
Figure 8A:
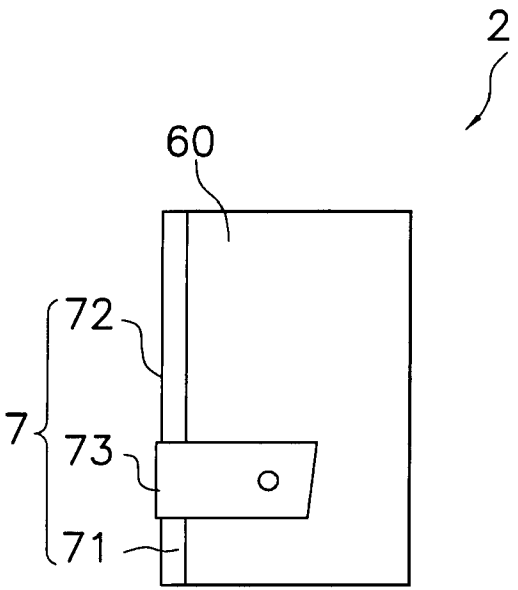

The third panel 73 is disposed between the first panel 71 and the second panel 72. The third panel 73 has a seamless rectangular shape in the front view. The third panel 73 has a width W that is substantially equal to that of the front grill 60, and has a length in an up and down direction that is substantially equal to that of the first panel 71. The front side of the third panel 73 is formed in a generally flat shape with a smooth texture without a concave or convex portion, opening such as a hole, or the like. As shown in FIG. 8(*a*), portions near left and right ends of the third panel 73 are respectively fixed to left and right side surfaces of the front grill 60, and the third panel 73 is disposed such that a front surface portion thereof is spaced apart from the front of the front grill 60 in a front and back direction. In other words, behind the front surface portion of the third panel 73, there is formed a gap between there and the front grill 60. This gap is formed slightly larger than the thickness of the first panel 71 disposed below, and the gap serves as a space for housing the first panel 71 that moves to open the outlet 26. In addition, the third panel 73 is molded from an opaque resin material.

In this way, in the state in which the outlet 26 is closed by the first panel 71, the first panel 71 completely covers the front lower portion of the front grill 60 including the outlet 26, and in the state in which the first intake port 27 is closed by the second panel 72, the second panel 72 completely covers the front upper portion of the front grill 60 including the first intake port 27. In addition, the first panel 71, the second panel 72, and the third panel 73 are disposed such that they are aligned above and below one another. In the state in which the outlet 26 and the first intake port 27 are closed, they are disposed so as to configure a generally flat, rectangular plane. In the state in which the outlet 26 and the first intake port 27 are closed, the front panel 7 configured by the first panel 71, the second panel 72, and the third panel 73 cover the generally entire front of the indoor unit 2, and only the seams created at the borderlines of the first panel 71, the second panel 72, and the third panel 73 appear. In other words, only the horizontally extending seams created at the borderline between the first panel 71 and the third panel 73 and at the borderline between the second panel 72 and the third panel 73 appear in the front view. Further, the first panel 71, the second panel 72, and the third panel 73 are parallel to an up and down direction, and in the state in which the outlet 26 and the first intake port 27 are closed by the front panel 7, the front panel 7 forms a flat surface that is parallel to an up and down direction. With this indoor unit 2 of the air conditioner 1, since the front panel 7 is formed to have such a flat shape, the aesthetic appearance is enhanced.

<Movement of the Front Panel at Start-Up of the Operation>

When the indoor unit 2 is shut down, the front panel 7 is in a state of closing the outlet 26 and the first intake port 27 as described above. When the indoor unit 2 starts operating, first, the indoor fan 21 is started at a low rotation speed. Then, the first panel 71 and the second panel 72 move, and the outlet 26 and the first intake port 27 are opened. As a result, a volume of air to be drawn into the indoor unit 2 is ensured, and also air is blown out in the horizontal direction. Below, a description is provided mainly focusing on the movements of the front panel 7 based on FIGS. 8(*a*), 8(*b*), and 8(*c*). Note that FIGS. 8(*a*), 8(*b*), and 8(*c*) are the side views of the indoor unit 2.

In a state in which the indoor unit 2 is shut down, the first panel 71 and the second panel 72 close the outlet 26 and the first intake port 27. As shown in FIG. 8(*a*), the first panel 71, the second panel 72, and the third panel 73 are disposed in a generally straight line parallel to an up and down direction in the side view. In addition, the front sides of the first panel 71, the second panel 72, and the third panel 73 are formed to be generally flat. Note that in this state, the first panel supporting member 67 of the opening and closing mechanism 61 is positioned at the lowest portion within the range of movement. In addition, the second panel supporting member 68 is positioned at the rearmost portion within the range of movement.

When the indoor unit 2 starts operating, the panel opening and closing motor 43 of the driving machine 41 is controlled and starts rotating. Then, the driving force of the driving machine 41 is transmitted to the power transmission shaft 65, and the driving force is distributed and transmitted to the first opening and closing mechanism 63 and the second opening and closing mechanism 64. Then, the first panel 71 and the second panel 72 are moved by the first opening and closing mechanism 63 and the second opening and closing mechanism 64, and consequently the outlet 26 and the first intake port 27 are opened.

At this time, with the first opening and closing mechanism 63, the driving force is transmitted to the first panel supporting member 67 via the first opening and closing gear 630 and the second opening and closing gear 631. When the driving force is transmitted from the second opening and closing gear 631 to the first gear portion 670 of the first panel supporting member 67, the rotary motion is converted into an upward linear motion, and consequently the first panel supporting member 67 moves linearly upward. Also with the second opening and closing mechanism 64, the driving force of the same driving machine 41 is transmitted, and consequently a similar movement is performed. As a result, as shown in FIG. 8(*b*), the first panel 71 moves upward parallel to an up and down direction so as to open the outlet 26. When the first panel 71 moves upward in an up and down direction, an upper end of the first panel 71 will be inserted to the gap formed behind the third panel 73. When the first panel 71 moves further upward, as shown in FIG. 8(*c*), the first panel 71 will be housed in the gap between the third panel 73 and the front grill 60, and the first panel 71 will be hidden behind the third panel 73. In other words, the generally entire first panel 71 will be overlapped by the third panel 73.

In addition, linking such movements of the first panel 71, the second panel 72 also moves. At this time, with the first opening and closing mechanism 63, the above described rotation of the second opening and closing gear 631 is transmitted simultaneously to the second gear portion 680 of the second panel supporting member 68. Then, when the driving force is transmitted from the second opening and closing gear 631 to the second gear portion 680 of the second panel supporting member 68, the rotary motion is converted into the gentle circular arc motion, and consequently the second panel supporting member 68 moves forward along a gentle circular arc path. This circular arc path is a path along which the second panel supporting member 68 moves forward and also an upper end of the second panel supporting member 68 leans forward. Also with the second opening and closing mechanism 64, the driving force of the same driving machine 41 is transmitted, and consequently a similar movement is performed. As a result, the second panel supporting member 68 protrudes forward from the front of the front grill 60. Consequently, as shown in FIG. 8(*b*), the second panel 72 moves forward, and also rotates about the axis that is parallel to a left to right direction in the front view. The second panel 72 rotates about a portion near a lower end thereof such that its upper end leans forward. As shown in FIG. 8(*c*), the second panel 72 moves further, and consequently a gap is formed between the front grill 60 and the second panel 72. As a result, the first intake port 27 is opened. Then, air is drawn in from the gap between the upper end of the second panel 72 and the front grill 60, and the air is drawn into the indoor unit 2 from the first intake port 27. Note that, at this time, both sides of the gap between the front grill 60 and the second panel 72 are covered by the second panel supporting member 68, and the space above the gap between the front grill 60 and the second panel 72 is open. Consequently, air is drawn in mainly from the top portion of the gap between the front grill 60 and the second panel 72.

Once the front panel 7 moves and the outlet 26 and the first intake port 27 are opened, the horizontal flap 50 (refer to FIG. 2) rotatably moves such that it is positioned at an outlet angle that corresponds to the set operation mode.

In addition, when the indoor unit 2 is shut down, the panel opening and closing motor 43 of the driving machine 41 is controlled so as to rotate in the reverse direction, and consequently the first panel supporting member 67 and the second panel supporting member 68 move in a direction opposite to the above described direction. As a result, the first panel 71 and the second panel 72 move in the direction opposite to the above described direction, and consequently the front panel 7 returns to its flat form.

<Method for Assembling the Indoor Unit of the Air Conditioner>

Next, a method for assembling the above described indoor unit 2 of the air conditioner 1 is described.

Figure 9:
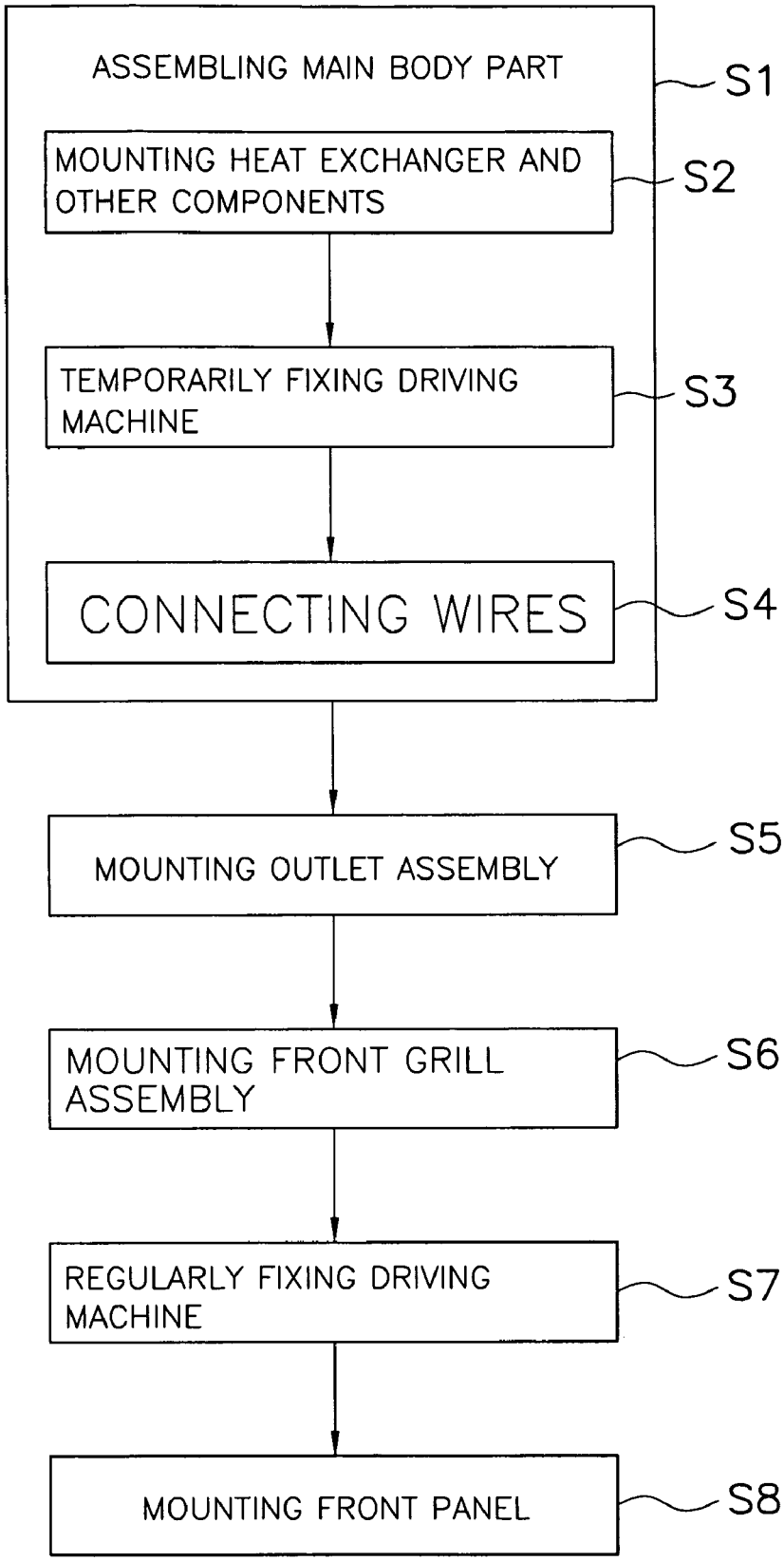
FIG. 9 is a flow showing a method for assembling the indoor unit.

As shown in FIG. 9, this method for assembling the indoor unit 2 of the air conditioner 1 mainly includes step S1 of assembling the main body part 4, step S5 of mounting the outlet assembly 5, step S6 of mounting the front grill assembly 6, step S7 of regularly fixing the driving machine 41, and step S8 of mounting the front panel 7.

Step S1 of assembling the main body part 4 further includes step S2 of mounting the heat exchanger and other components, step S3 of temporarily fixing the driving machine 41, and step S4 of connecting wires.

In step S2 of mounting the heat exchanger and other components, components such as the indoor heat exchanger 20, the indoor fan 21, the indoor fan motor 22, and the electrical component box 40 are mounted to the main body casing 42.

In step S3 of temporarily fixing the driving machine 41, the driving machine 41 is temporarily fixed to the locking clip 490 (temporary fixing portion, clip portion) on the left side portion 49 of the main body casing 42. Here, when the locking clip 490 on the left side portion 49 is inserted into the locking hole 461 in the driving machine 41 and held therein, the driving machine 41 is consequently temporarily fixed to the left side portion 49. Consequently, with this indoor unit 2 of the air conditioner 1, at least when mounting the front grill 60 to the main body casing 42, the driving machine 41 is provided at the main body casing 42 side. The temporarily fixed driving machine 41 is disposed such that the fixed portion 462 of the driving machine 41 will generally coincide with the fixing portion 62 of the front grill 60 in a state in which the front grill 60 is mounted to the main body part 4.

In step S4 of connecting wires, the panel opening and closing motor 43 of the driving machine 41 and the control board of the electrical component box 40 are connected via a cable 430. Note that the cable 430 is extended along the main body casing 42 from the driving machine 41 to the electrical component box 40.

Next, in step S5 of mounting the outlet assembly 5, the outlet assembly 5 is mounted to the main body part 4. The outlet assembly 5 is mounted to the main body part 4 such that the space wherein the indoor fan 21 of the main body part 4 is housed communicates with the outlet 26.

In step S6 of mounting the front grill assembly 6, the front grill assembly 6 is mounted to the main body part 4. The front grill assembly 6 covers the main body part 4 from the front of the main body part 4, and is fixed to the main body part 4 by screwing or fitting In step S7 of regularly fixing the driving machine 41, the temporarily fixed driving machine 41 is regularly fixed to the front panel 7. Here, a screw is threaded into the screw hole in the fixing portion 62 of the front panel 7 and the screw hole in the fixed portion 462 of the driving machine 41. Consequently, the driving machine 41 and the front panel 7 are fixed to each other. At this time, the driving machine 41 is in a state of being temporarily fixed to the main body casing 42, and the screw hole in the fixing portion 62 of the front panel 7 and the screw hole in the fixed portion 462 of the driving machine 41 are disposed adjacent each other. In addition, even if the screw hole in the fixing portion 62 of the front panel 7 is not completely coinciding with the screw hole in the fixed portion 462 of the driving machine 41, screwing can be easily performed by slightly moving the driving machine 41 to coincide the screw hole in the fixing portion 62 with the screw hole in the fixed portion 462.

Then, in step S8 of mounting the front panel 7, the front panel 7 is mounted to the front grill 60. Here, the first panel 71 and the second panel 72 are respectively fixed to tip portions of the first panel supporting member 67 and tip portions of the second panel supporting member 68 of the opening and closing mechanism 61, with the tip portions protruding from the slits 600 to 603 at the front of the front grill 60. In addition, the third panel 73 is fixed to the front grill 60.

Note that each of steps S1 to S8 does not have to be performed in the above described order. If possible, the order can be altered.

<Characteristic>

(1)

With this indoor unit 2 of the air conditioner 1, the opening and closing mechanism 61 that opens and closes the front panel 7 is provided at the front grill 60. Consequently, the mounting accuracy between the front grill 60 and the first panel 71 and between the front grill 60 and the second panel 72 will improve, compared to the case where the opening and closing mechanism 61 is provided at the main body part 4. Consequently, the gap or a joint between the front grill 60 and the first panel 71 and between the front grill 60 and the second panel 72 can be maintained uniformly, and the design can therefore be easily enhanced.

In addition, the first opening and closing mechanism 63 and the second opening and closing mechanism 64 each are formed as a unit, and they are provided at the front grill 60. Consequently, the first opening and closing mechanism 63 and the second opening and closing mechanism 64 can be easily mounted to the front grill 60, and the productivity will therefore improve.

Further, the first opening and closing mechanism 63 and the second opening and closing mechanism 64 are respectively fixed to the inner surfaces of the left and right sides of the front grill 60. Therefore, there is a low risk that they will interfere with the mounting of the front grill 60 to the main body part 4. Consequently, the front grill 60 can also be easily mounted to the main body part 4.

(2)

With this indoor unit 2 of the air conditioner 1, even when the second panel 72 moves in the opening direction and the first intake port 27 is opened, the plate member 681 of the second panel supporting member 68 covers the sides of the gap between the second panel 72 and the front grill 60. In addition, since the components such as the gear portion of the opening and closing mechanism 61 are positioned inside the plate member, a room occupant is prevented from touching the components such as the gear portion with his or her hands. Thus, the safety will be improved.

In addition, since the plate member 681 covers the sides of the gap between the second panel 72 and the front grill 60, it is possible to make movable components such as the opening and closing member and the gear difficult to be seen from outside. Therefore, the design during the moving of the second panel 72 will be enhanced.

Further, the second panel supporting member 68 is integrally molded, and the plate member 681 and the second gear portion 680 are integrated into a single unit. Consequently, the number of components is reduced, and the space that has been occupied by peripheral components can be eliminated. In addition, since the second gear portion 680 and the plate member 681 are integrated, the strength of the second gear portion 680 itself will improve.

As discussed above, with this indoor unit 2 of the air conditioner 1, the second panel supporting member 68 for supporting and moving the second panel 72 is also used as a member for preventing a person from inserting his or her hand into the unit 2 and for concealing the inside of the indoor unit 2. Thus, the second panel supporting member 68 is utilized effectively as a multifunctional component.

(3)

With this indoor unit 2 of the air conditioner 1, since the driving machine 41 is arranged to be temporarily fixed to the main body part 4, the wiring procedure will be easy when mounting the front panel 7 to the main body part 4, compared to the case where the driving machine 41 is fixed to the front panel 7. In other words, when mounting the front panel 7 to the main body part 4, if the driving machine 41 was fixed to the front panel 7, the wiring would extend from the front panel 7 side to the main body part 4 side. This would make the wiring procedure difficult. However, by temporarily fixing the driving machine 41 to the main body part 4, the wiring is prevented from being extended from the front panel 7 side to the main body part 4 side when the front panel 7 is mounted to the main body part 4.

In addition, since the driving machine 41 transmits the driving force to the opening and closing mechanism 61, the driving machine 41 and the opening and closing mechanism 61 need to be aligned with each other. With this indoor unit 2 of the air conditioner 1, the driving machine 41 is fixed to the front grill 60 after the front grill 60 is mounted to the main body part 4. In other words, since the driving machine 41 is ultimately fixed to the front grill 60, it results in an improved the mounting accuracy between the opening and closing mechanism 61 and the driving machine 41 to be provided at the front grill 60.

(4)

With this indoor unit 2 of the air conditioner 1, the driving force of the driving machine 41 is distributed and transmitted to the first opening and closing mechanism 63 and the second opening and closing mechanism 64, and the portions near both the right and left ends of the first panel 71 and the second panel 72 move in a linked manner. Accordingly, the movements of the first panel 71 and the second panel 72 in a left to right direction are performed in precise synchronization. As a result, the first panel 71 and the second panel 72 are prevented from being deformed, and they can move smoothly.

In addition, since the driving force of the driving machine 41 is distributed and transmitted to the first panel supporting member 67 and the second panel supporting member 68, the first panel 71 and the second panel 72 move in a linked manner. Consequently, the opening and closing movements of the first intake port 27 and the outlet 26 can be easily performed in synchronization.

Further, a total of four movements including the movements near both the right and left ends of the first panel 71 and the second panel 72 and the movements of the first panel 71 and the second panel 72 are performed by the driving force of the single panel opening and closing motor 43. Consequently, the synchronization of these four movements can be performed precisely, and the opening and closing movements can be performed in a timely manner.

Other Embodiments (1)

In the above described embodiment, the opening and closing mechanism 61 has a function for converting the rotary motion transmitted from the driving machine 41 to a linear motion or a circular arc motion; however, the types of conversions of motions performed by the opening and closing mechanism 61 are not limited to those above. For example, the opening and closing mechanism 61 may be a mechanism, to which a linear motion is transmitted from the driving machine 41, and which converts the linear motion to the opening and closing movements of the first panel 71 and the second panel 72.

(2)

In the above described embodiment, the first opening and closing mechanism 63 and the second opening and closing mechanism 64 are provided respectively at the inner surfaces of the left and the right sides of the front grill 60; however, the positions of the first opening and closing mechanism 63 and the second opening and closing mechanism 64 are not limited to those above. A different arrangement may be possible depending on the shape of the front grill 60 or the position of the front panel 7.

(3)

In the above described embodiment, the second panel supporting member 68 is integrally molded; however, the separate bodies of the plate member 681 and the gear portion may be used. However, it is more preferable that they are integrally molded in view of the reduction of the number of components.

(4)

In the above described embodiment, the temporary fixation is performed with the locking clip 490 on the main body part 4 and the locking hole 461 in the driving machine 41; however, the locking clip 490 may be provided on the driving machine 41 and the locking hole 461 may be provided in the main body part 4. In addition, components for the temporary fixation are not limited to the locking clip 490 and the locking hole 461; a different component may be used, with which the driving machine 41 can be temporarily fixed to the main body part 4.

(5)

The structure of the temporary fixation in the above embodiment is effective not only for the opening and closing of the first panel 71 and the second panel 72 but also for when it is necessary to transmit the driving force from the main body part 4 to the front grill 60 that is provided with some type of movable components.

(6)

In the above described embodiment, the power transmission shaft 65 of the opening and closing mechanism 61 distributes the driving force of the driving machine 41; however, it is not limited to such a shaft member, and a different member may be used to distribute the driving force.

INDUSTRIAL APPLICABILITY

The present invention is effective in improving the mounting accuracy between the front grill and the first movable panel that is opened and closed by the opening and closing mechanism, and the present invention is useful as an indoor unit of an air conditioner.

What is claimed is:

1. An indoor unit of the air conditioner, comprising:

a main body casing;

a front grill provided forward of the main body casing and having a first opening and a second opening;

a first movable panel configured to move so as to open and close the first opening;

a second movable panel capable of moving so as to open and close the second opening;

a drive portion configured to generate a driving force to move the first and second movable panels; and an opening and closing mechanism provided at the front grill, the opening and closing mechanism being configured to move the first movable panel by the driving force of the drive portion to open and close the first opening and configured to move the second movable panel to open and close the second opening by the driving force of the drive portion, the opening and closing mechanism including a first opening and closing mechanism for moving one end of the first movable panel by the driving force of the drive portion, and a second opening and closing mechanism for moving the other end of the first movable panel by the driving force of the drive portion, the opening and closing mechanism distributing the driving force from the drive portion to the first opening and closing mechanism and the second opening and closing mechanism.

2. The indoor unit of the air conditioner according to claim 1, wherein the opening and closing mechanism includes a supporting member mounted to the first movable panel to support the first movable panel.

3. The indoor unit of the air conditioner according to claim 1, wherein the opening and closing mechanism includes a speed reducing mechanism for transmitting the driving force of the drive portion to the first movable panel.

4. The indoor unit of the air conditioner according to claim 1, wherein the opening and closing mechanism includes a converting mechanism for converting a rotary motion transmitted from the drive portion to opening and closing movements of the first movable panel.

5. The indoor unit of the air conditioner according to claim 1, wherein the first opening and closing mechanism and the second opening and closing mechanism each are formed as a unit.

6. The indoor unit of the air conditioner according to claim 5, wherein the first opening and closing mechanism and the second opening and closing mechanism are provided such that they are respectively fixed to inner surfaces of left and right sides of the said front grill.

7. The indoor unit of the air conditioner according to claim 1, wherein at least when mounting the front grill to the main body casing, the drive portion is provided in the main body casing.

8. An indoor unit of the air conditioner, comprising:

a main body casing;

a front grill provided forward of the main body casing and having a first opening;

a first movable panel configured to move so as to open and close the first opening;

a drive portion configured to generate a driving force to move the first movable panel;

an opening and closing mechanism provided at the front grill and configured to move the first movable panel by the driving force of the drive portion to open and close the first opening, the opening and closing mechanism including a first opening and closing mechanism for moving one end of the first movable panel by the driving force of the drive portion, and a second opening and closing mechanism for moving the other end of the first movable panel by the driving force of the drive portion, the opening and closing mechanism distributing the driving force from the drive portion to the first opening and closing mechanism and the second opening and closing mechanism, and the main body casing including a second gear disposed so as to engage with a first gear included in the opening and closing mechanism in a state in which the front grill is mounted to the main body casing, and configured to transmit the driving force of the drive portion to the opening and closing mechanism.

9. An indoor unit of the air conditioner, comprising:

a main body casing provided with a control component;

a front grill provided forward of the main body casing and having a first opening;

a first movable panel configured to move so as to open and close the first opening;

a drive portion configured to generate a driving force to move the first movable panel, the drive portion including a motor connected to the control component and configured to move the first movable panel;

an opening and closing mechanism provided at the front grill and configured to move the first movable panel by the driving force of the drive portion to open and close the first opening, the opening and closing mechanism including a first opening and closing mechanism for moving one end of the first movable panel by the driving force of the drive portion, and a second opening and closing mechanism for moving the other end of the first movable panel by the driving force of the drive portion, the opening and closing mechanism distributing the driving force from the drive portion to the first opening and closing mechanism and the second opening and closing mechanism, the main body casing including a temporary fixing portion for temporarily fixing the drive portion, and the front grill including a fixing portion for fixing the drive portion that is temporarily fixed.

10. The indoor unit of the air conditioner according to claim 9, wherein the drive portion is temporarily fixed with the temporary fixing portion such that the drive portion is capable of moving to a position where the drive portion is to be fixed with the fixing portion when the drive portion is fixed with the fixing portion.

11. The indoor unit of the air conditioner according to claim 9, wherein the temporary fixing portion includes a clip portion for holding the drive portion and temporarily fixing the drive portion.

12. The indoor unit of the air conditioner according to claim 7, wherein the opening and closing mechanism includes a supporting member mounted to the first movable panel to support the first movable panel.

13. The indoor unit of the air conditioner according to claim 7, wherein the opening and closing mechanism includes a speed reducing mechanism for transmitting the driving force of the drive portion to the first movable panel.

14. The indoor unit of the air conditioner according to claim 7, wherein the opening and closing mechanism includes a converting mechanism for converting a rotary motion transmitted from the drive portion to opening and closing movements of the first movable panel.

15. An indoor unit of the air conditioner, comprising:

a main body casing;

a front grill provided forward of the main body casing and having an intake port and an outlet portion;

a first movable panel configured to move so as to open and close the intake port;

a second movable panel configured to move so as to open and close the outlet portion, the second movable panel being different from the first movable panel;

a drive portion configured to generate a driving force to move the first and second movable panels; and an opening and closing mechanism provided at the front grill, the opening and closing mechanism being configured to move the first movable panel by the driving force of the drive portion so as to open and close the intake port and being configured to move the second movable panel so as to open and close the outlet portion, with the opening and closing mechanism further distributing the driving force of the drive portion so as to move the first movable panel and the second movable panel, the opening and closing mechanism including a first opening and closing mechanism for moving one end of the first movable panel by the driving force of the drive portion, and a second opening and closing mechanism for moving the other end of the first movable panel by the driving force of the drive portion, the opening and closing mechanism distributing the driving force from the drive portion to the first opening and closing mechanism and the second opening and closing mechanism.

16. An indoor unit of the air conditioner, comprising:

a main body casing with a heat exchanger provided therein;

a front grill provided forward of the main body casing and having a first opening;

a first movable panel configured to move so as to open and close the first opening;

a drive portion configured to generate a driving force to move the first movable panel;

an opening and closing mechanism provided at the front grill and configured to move the first movable panel by the driving force of the drive portion to open and close the first opening, the opening and closing mechanism including a first opening and closing mechanism for moving one end of the first movable panel by the driving force of the drive portion, a second opening and closing mechanism for moving the other end of the first movable panel by the driving force of the drive portion, and a power transmission shaft for transmitting the driving force from the drive portion to the first opening and closing mechanism and the second opening and closing mechanism so that the first opening and closing mechanism and the second opening and closing mechanism perform in synchronization, the opening and closing mechanism distributing the driving force from the drive portion to the first opening and closing mechanism and the second opening and closing mechanism by the power transmission shaft, the drive portion being disposed to be deflected to one side of the first opening and closing mechanism and the second opening and closing mechanism; and a gear provided in the power transmission shaft and disposed at the outer side of the heat exchanger in the longitudinal direction of the indoor unit and configured to transmit the driving force to the power transmission shaft from the drive portion.

17. The indoor unit of the air conditioner according to claim 1, wherein the first movable panel has upper and lower ends that both move laterally away from the front grill when the first movable panel moves from a closed position closing the first opening to an open position opening the first opening.

18. The indoor unit of the air conditioner according to claim 17, wherein a main body casing;

a front grill provided forward of the main body casing and having a first opening;

a first movable panel configured to move so as to open and close the first opening;

a drive portion configured to generate a driving force to move the first movable panel; and an opening and closing mechanism provided at the front grill and configured to move the first movable panel by the driving force of the drive portion to open and close the first opening, the opening and closing mechanism including a first opening and closing mechanism for moving one end of the first movable panel by the driving force of the drive portion, a second opening and closing mechanism for moving the other end of the first movable panel by the driving force of the drive portion, and a power transmission shaft for transmitting the driving force from the drive portion to the first opening and closing mechanism and the second opening and closing mechanism so that the first opening and closing mechanism and the second opening and closing mechanism perform in synchronization, the opening and closing mechanism distributing the driving force from the drive portion to the first opening and closing mechanism and the second opening and closing mechanism by the power transmission shaft, and the drive portion being disposed to be deflected to one side of the first opening and closing mechanism and the second opening and closing mechanism, the first movable panel having upper and lower ends that both move laterally away from the front grill when the first movable panel moves from a closed position closing the first opening to an open position opening the first opening, and the first movable panel further pivoting pivots when the first movable panel moves from the closed position closing the first opening to the open position opening the first opening such that the bottom of the first movable panel is located closer to the front grill than the top of the first movable panel in the open position, and the bottom of the first movable panel and the top of the first movable panel are vertically aligned in the closed position.

* * * * *

UNITED STATES PATENT AND TRADEMARK OFFICE

CERTIFICATE OF CORRECTION

PATENT NO. : 7,758,409 B2
APPLICATION NO. : 10/573042
DATED : July 20, 2010
INVENTOR(S) : Tetsuya Yamashita et al.

It is certified that error appears in the above-identified patent and that said Letters Patent is hereby corrected as shown below:

Column 24,
Line 37, "the first movable panel further pivoting pivots when the" should read -- the first movable panel further pivoting when the --.

Signed and Sealed this

Twelfth Day of October, 2010

David J. Kappos

David J. Kappos
*Director of the United States Patent and Trademark Office*